US005524600A

United States Patent [19]

Wild

[11] Patent Number: 5,524,600

[45] Date of Patent: Jun. 11, 1996

[54] METHOD AND ARRANGEMENT FOR CONTROLLING A TANK-VENTING APPARATUS

[75] Inventor: Ernst Wild, Oberriexingen, Germany

[73] Assignee: Robert Bosch GmbH, Stuttgart, Germany

[21] Appl. No.: 259,528

[22] Filed: Jun. 14, 1994

[30] Foreign Application Priority Data

Jun. 15, 1993 [DE] Germany ..... 43 19 772.8

[51] Int. Cl.[6] ..... F02M 25/08; F02D 41/14

[52] U.S. Cl. ..... 123/698

[58] Field of Search ..... 123/674, 698, 123/520

[56] References Cited

U.S. PATENT DOCUMENTS

| | | | |
|---|---|---|---|
| 4,683,861 | 8/1987 | Breitkreuz et al. | 123/698 |
| 5,048,493 | 9/1991 | Orzel et al. | 123/674 |
| 5,072,712 | 12/1991 | Steinbrenner et al. | 123/698 X |
| 5,090,388 | 2/1992 | Hamburg et al. | 123/674 |
| 5,150,686 | 9/1992 | Okawa et al. | 123/698 |
| 5,203,300 | 4/1993 | Orzel | 123/339 |

FOREIGN PATENT DOCUMENTS 2269028 1/1994 United Kingdom .

*Primary Examiner*—Tony M. Argenbright
*Attorney, Agent, or Firm*—Walter Ottesen

[57] ABSTRACT

The invention relates to a method and an apparatus for controlling a tank-venting apparatus. The method affords the advantage that the volume flow changes are compensated before they operate on the composition of the mixture inducted by the engine. In cases where desired, a further advantage is that the tank-venting apparatus can always be scavenged with the maximum possible vapor flow during the actual operating state then occurring.

5 Claims, 3 Drawing Sheets

First Maximum-Value Limiting Unit
ndte
vtev
31
32.1
32.2
Up/Down Control Unit
vtev-
Second Maximum-Value Limiting Unit
Preset Unit
33
34
27
Intake-Pipe Pressure Characteristic-Field Memory
Tank-Venting Valve Characteristic-Line Memory vtev
vtev-max
vtev / vtev_max
S_TEV
35
36
37
19
Pulse-Duty Factor Determining Unit
Linearization Unit
Driver Unit
Drive Unit Start Detect Operating State of the Internal Combustion Engine; Determine vtev and adjust
S1
Determine Adaptation Integration Value idte
S2
Determine Adaptation Addend adte = idte (vtev/MAX(vtev)); Correct injected Fuel Volume Flow with adte
S3
S4
vtev >MAX(vtev)
S5
MAX(vtev) = vtev
no
S6
no
End ?
End

METHOD AND ARRANGEMENT FOR CONTROLLING A TANK-VENTING APPARATUS

FIELD OF THE INVENTION

The invention relates to a method and an arrangement for controlling a tank-venting system which is connected to the intake pipe of an internal combustion engine via a tank-venting valve. The tank-venting system includes an adsorption filter which connects the tank to the tank-venting valve. As a rule, the adsorption filter is filled with active charcoal.

BACKGROUND OF THE INVENTION

A method and an arrangement for controlling a tank-venting system are disclosed in U.S. Pat. No. 4,683,861. In this method, the pulse-duty factor of the tank-venting valve is so adjusted that the percentage enrichment of the combustion mixture supplied to the engine is of the same magnitude for a given tank-venting mixture in all ranges. It should be noted that it is not only a percentage enrichment which occurs but also a percentage leaning of the mixture when the venting vapor contains more air than what corresponds to the stoichiometric composition. The foregoing means that the tank-venting valve is adjusted in dependence upon the particular actual operating state of the engine so that the volume flow of the venting vapor through the tank-venting valve constitutes a specific percentage of the vapor flow which the engine draws in by suction.

The pregiven percentage is referred to an engine which is driven without disturbances. However, if the engine, for example, draws in leakage air then the pregiven pulse-duty factor for the tank-venting valve no longer reads to the same percentage portion of the venting vapor in the total vapor when different air throughputs through the intake pipe occur; instead, the proportion in each case is now dependent upon the air throughput. This means that for each change of the vapor throughput through the engine for changes in the operating state thereof a change of the air ratio of the mixture drawn in by suction occurs which is caused by the percentage of the venting vapor throughput which is no longer appropriate. This change of the air number must be corrected by a mixture controller for each change of the air throughput.

SUMMARY OF THE INVENTION

It is an object of the invention to provide a method and an arrangement for controlling a tank-venting system which are so configured that a mixture controller must carry out as few corrections as possible when there is a change in the air throughput through the intake pipe of an internal combustion engine when tank venting takes place.

The method of the invention is for controlling a tank-venting apparatus for an internal combustion engine having an intake pipe, the tank-venting apparatus being connected to the intake pipe via a tank-venting valve through which venting vapor is drawn from the tank-venting apparatus into the intake pipe. The method includes the steps of: presetting the volume flow for the venting vapor drawn from the tank-venting apparatus into the intake pipe in dependence upon the particular operating state of the engine; adjusting the volume flow by correspondingly driving the tank-venting valve thereby reducing or increasing the volume flow; forming an adaptation addend with the aid of a mixture controller; and, changing the adaptation addend in the same direction as the volume flow is changed when the volume flow is reduced.

The arrangement of the invention is for controlling a tank-venting apparatus for an internal combustion engine having an intake pipe, the tank-venting apparatus being connected to the intake pipe via a tank-venting valve through which venting vapor is drawn from the tank-venting apparatus to the intake pipe. The arrangement includes: means for detecting the operating state of the engine; means for outputting a precontrol value for the mixture setting of the engine in dependence upon the operating state thereof; a mixture controller for outputting a correcting variable during a tank-venting phase; an adaptation integrator for receiving the correcting variable to form an adaptation variable; means for driving the tank-venting valve so that a pregiven volume flow through the tank-venting valve adjusts in dependence upon the operating state of the engine thereby reducing or increasing the volume flow; means for modifying the adaptation variable at least for each reduction of the volume flow in the same direction as the volume flow is changed when the volume flow is reduced thereby forming a modified adaptation variable; and, summing means for adding the modified adaptation variable to the precontrol value.

The method of the invention is characterized in that the pulse-duty factor for the tank-venting valve is no longer so adjusted that a vapor throughput is set which corresponds to a specific percentage of the air throughput through the intake pipe; instead, a pregiven volume flow of the venting vapor is adjusted. The volume flow of the venting vapor is fixedly pregiven. For this reason, the action of the venting vapor on the composition of the mixture drawn in by the engine can be very reliably predicted which, in turn, makes possible another essential feature of the invention, namely, it is possible to change an adaptation variable in the same direction as the change of the volume flow when changes of volume flow occur because of changes in the operating state of the engine. The adaptation variable is considered additively in the mixture control.

For the purpose of illustration, the assumption is made that more fuel is contained in the vapor drawn by suction from the tank-venting system than corresponds to the stoichiometric mixture composition. The excess quantity of fuel is assumed to be 100 g/h. The mixture control then sets the adaptation addend during tank venting so that 100 g/h less fuel is injected than when the tank venting is switched off. If the operating state of the engine changes while tank venting takes place so that the volume flow of the venting vapor is doubled, then the adaptation addend is doubled and set to 200 g/h. The mixture controller must therefore no longer become active when a change in the operating state of the engine takes place in order to correctly set the desired mixture when tank-venting is occurring. The mixture controller must only then become active when the composition of the venting vapor drawn by suction from the tank-venting system changes.

The measure of the invention described above makes it possible without difficulty to operate with the volume flow of the venting vapor which is a maximum for an operating state in order to optimally scavenge the adsorption filter in the tank-venting system.

The example given above for the purposes of explanation assumes that the air/fuel vapor composition of the venting vapor is independent of the volume flow through the tank-venting valve; that is, the adaptation addend pregiven by the fuel correction must be doubled when the volume flow doubles. This, however, is not always the case and especially not when an adsorption filter is used which is connected only via a T-member to a line leading from the tank to the tank-venting valve. If in this case, 100 g/h fuel vaporizes from the tank and the tank-venting valve is set for precisely this volume flow, then the venting vapor essentially comprises fuel vapor.

If the volume flow is now doubled, this takes place in that, in addition to the 100 g/h of fuel vapor, 100 g/h of air is drawn by suction through the adsorption filter. The adaptation addend must then remain essentially constant since, notwithstanding the change of volume flow, the fuel vapor flow, which is to be compensated via the fuel injection, has not changed. The same applies in the reverse direction when the adaptation for the higher volume flow takes place and is then converted to a volume flow of 100 g/h without thereby changing the fuel vapor flow. In this case, the adaptation factor must not be halved but rather must remain essentially constant.

Notwithstanding the extreme cases just described, it is advantageous to change the adaptation addend proportionally to the gas-venting volume flow. The proportionality factor can then be a maximum of 1. If the method of the invention is applied to a tank-venting system having an adsorption filter connected to the T-member then it is, however, advantageous to select the proportionality factor to be less than 1.

From the two extreme cases described above, it is apparent that in the first extreme case, a leaning takes place when the volume flow is increased and, in the opposite case, an enrichment takes place. An enrichment is non-critical for the running engine; however, a leaning can lead to misfires. For this reason, it can be advantageous to change the adaptation addend only with volume flow reduction in the direction of the change of the volume flow.

When the volume flow of the venting gas, which flows through the tank-venting valve, is changed, this change operates only delayed by the vapor-running time between the tank-venting valve and the fuel injection device. It is therefore advantageous to change the adaptation addend also delayed by this vapor-running time after a change of the vapor throughput through the tank-venting valve.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
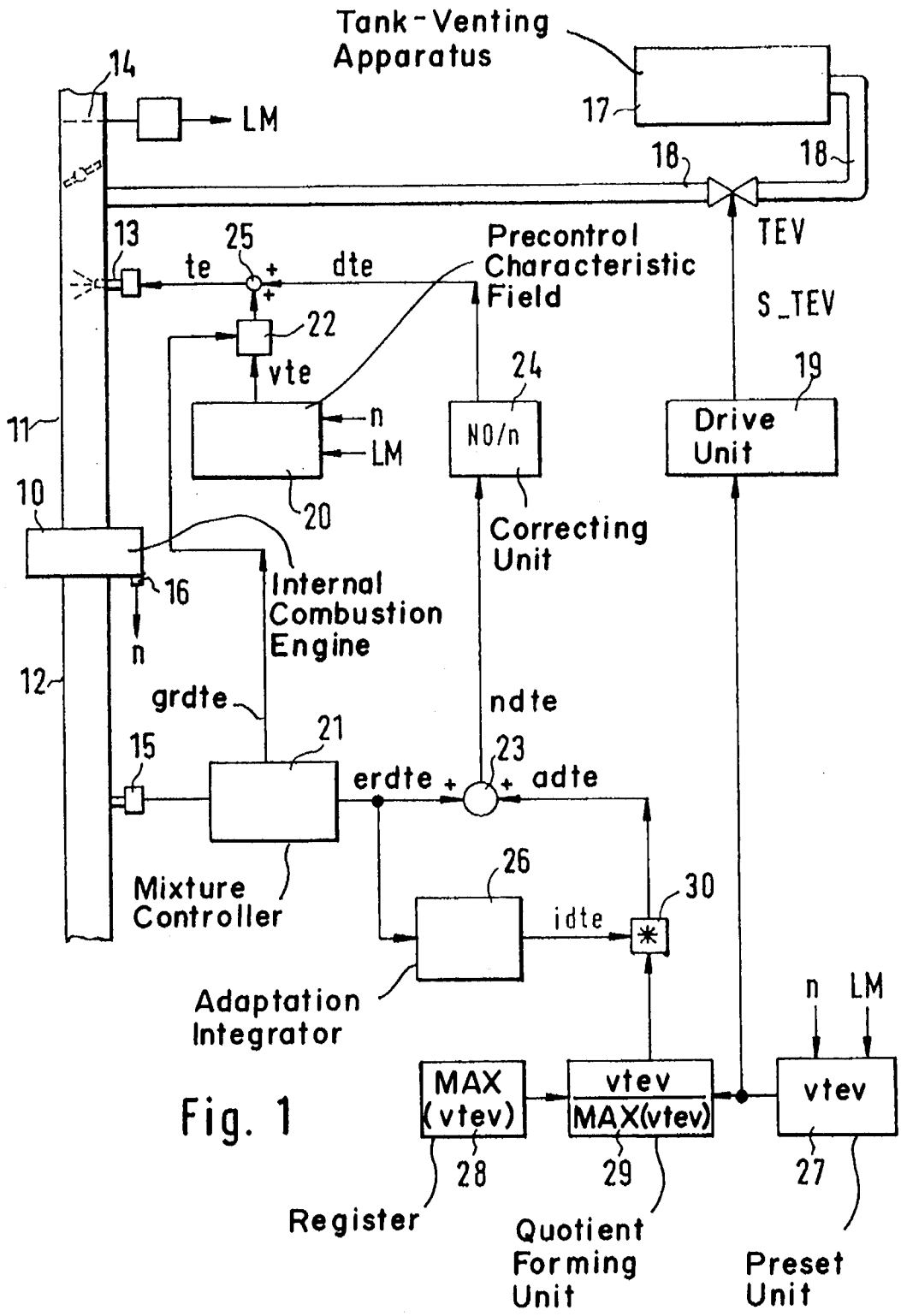
FIG. 1 is a function block diagram of an arrangement of the invention on an internal combustion engine equipped with a tank-venting system.

FIG. 1 shows an internal combustion engine 10 having an intake pipe 11 and an exhaust-gas pipe 12. A fuel-injection device 13 and an air-flow meter 14 are mounted in the intake pipe 11. The air-flow meter 14 emits a signal LM which indicates the air-mass flow through the intake pipe. A lambda probe 15 is provided in the exhaust-gas pipe 12 and an rpm sensor 16 is mounted on the engine.

A tank-venting system coacts with the engine 10 and includes a tank-venting apparatus 17 which is connected to the intake pipe 11 via a valve line 18. A tank-venting valve TEV is mounted in this valve line and is driven by a drive unit 19.

The engine 10 is alternately operated in a so-called base adaptation phase and in a so-called tank-venting phase. These phases each have a duration of several minutes. An injection time vte is determined in both phases from the precontrol characteristic field 20 in dependence upon the respective actual values of the rpm (n) and the air-mass signal LM. These injection times are so applied that, when the application conditions are present, precisely a desired mixture composition is set which is typically a stoichiometric mixture. However, if changes with respect to the application conditions are present (for example, a change in air pressure, a change of battery voltage or a disturbance such as leakage air), then the precontrol value vte must be modified in order to obtain the desired mixture composition. This takes place with the aid of a mixture controller 21 which, during the base adaptation phase, emits an actuating variable grdte which is logically combined in a logic combining unit 22 with the precontrol value vte, typically in a multiplicative manner. The modified value te is outputted to the injection device 13.

The correction variable grdte is determined during a base adaptation phase by the mixture controller 21 and is not changed during the tank-venting phase. Changes which the mixture controller 21 now determines are attributed to the operation of the tank-venting apparatus. If a stoichiometric mixture is drawn by suction from the tank-venting apparatus, then the lambda controller does not have to undertake a correction. If the mixture is a lean mixture, which in a limit case can be pure air, then the controller must output a correcting variable which increases the injection quantity. The opposite situation applies when the tank-venting apparatus supplies a rich mixture which, in the limit case, is pure fuel vapor. The correcting variable outputted by the mixture controller 21 during the tank-venting phase is identified in FIG. 1 by erdte. The correcting variable passes through an adaptation summation unit 23 where the correcting variable is additively combined logically with an adaptation addend adte which will be explained below. The sum signal is identified by ndte and must still be modified in dependence upon rpm. This modification is performed in a rpm-influenced correcting unit 24 which outputs a signal dte= ndte·(NO/n); wherein NO is a reference rpm and (n) is the actual rpm. This correcting value dte comes from the tank venting and is added to the signal outputted by the logic combining unit 22 which results in the final value for the injection time te for the injection device 13.

In the following, a description is provided as to how the adaptation addend adte is generated.

For adaptation, an adaptation integrator 26 is provided as usual to which the correcting signal erdte is supplied. The correcting signal is outputted by the mixture controller 21. The adaptation addend is first assumed to have the value 0 and the correcting value erdte then corresponds to an additional fuel quantity of 100 g/h. The adaptation integrator 26 then integrates until the adaptation addend has a value which corresponds to the 100 g/h fuel whereupon the correcting variable erdte, which is outputted by the mixture controller 21, has the value 0. The 100 g/h is applicable for a specific volume throughput through the tank-venting valve for a specific air/fuel ratio of the vapor drawn by suction through the tank-venting valve TEV from the tank-venting apparatus 17. If this ratio changes, a change of the mixture supplied to the engine 10 then occurs and this is announced by the lambda probe 15 to the mixture controller 21. Thereupon, the mixture controller 21 changes the correcting variable erdte in a correcting manner whereupon the adaptation integrator 26 again operates until the adaptation addend adte has taken up the change of the value erdte.

However, now a change of the volume flow through the tank-venting valve is considered for an air/fuel ratio of the vapor through the tank-venting valve TEV which is held constant. Changes of this kind can also be compensated with the aid of the adaptation described, namely, the lambda probe 15 determines a mixture change which is announced to the mixture controller 21 which, in turn, initiates operation of the adaptation integrator 26. The arrangement of the invention is however characterized by units which directly compensate such changes without causing a change of the composition of the mixture supplied to the engine 10. These units are the following: a preset unit 27 for the venting-vapor volume flow vtev, a register 28 for storing the maximum volume flow MAX (vtev) within a specific time duration, a quotient forming unit 29 and a multiplier unit 30.

For explaining the function of these devices, the first tank-venting phase after start of the engine is considered. Preset unit 27 outputs a previously applied value vtev for the volume flow through the tank-venting valve TEV with the value vtev having been stored in a characteristic field. The preset unit 27 emits the value vtev in dependence upon the actual operating state of the engine, that is, in dependence upon the actual values of the rpm (n) and the air mass LM. With this value vtev, the drive unit 19 drives the tank-venting valve in such a manner that this valve sets the desired volume flow. This is explained in greater detail with respect to FIG. 3.

Furthermore, the value vtev is written into the register 28 and the quotient of the value from the preset unit 27 and the value from the register 28 is formed in the quotient forming unit 29. Since both values are at first the same, the quotient has the value 1. This quotient is supplied to the multiplier unit 30 which multiplies the output value idte of the adaptation integrator 26 with the quotient of the value 1 whereby the adaptation addend adte is formed. The adaptation addend adte is supplied to the adaptation summing device 23.

It is now assumed that the operating state of the engine 10 has so changed that the preset unit 27 outputs a new value vtev which is only half the value originally assumed. This value now remains unchanged since the register 28 always sets the maximum value MAX (vtev) for the volume flow. The quotient forming unit 29 therefore outputs the quotient ½ by which the integration value idte is multiplied in the multiplier unit 30. In this way, the adaptation addend adte immediately drops to half the value as soon as the volume flow through the tank-venting valve is halved.

This procedure is based on the consideration that when the tank-venting apparatus 17 supplies a rich mixture and the volume flow through the tank-venting valve is halved, then only half the quantity of fuel vapor occurs so that the quantity of fuel to be injected must only be corrected with half the intensity than before.

With respect to sign, it should be noted that rich mixtures have lambda values <1 and therefore also supply correcting values <1. Accordingly, in the correcting summation unit 25, a negative value dte is added to the value outputted by the logic combining unit 22 so that the fuel injection device 13 injects less fuel than without the correction.

In the summary of the invention provided above, it was noted that a reduction of the volume flow through the tank-venting valve can, as a rule, be corrected with less difficulty than an increase of the volume flow. It is for this reason, that the maximum value for the volume flow is always written into the register 28. This maximum value can be newly determined for each tank-venting phase or this maximum value can apply for the entire driving cycle; that is, beginning with the start of the engine until the engine is switched off. Additionally, the engine temperature drops below a pregiven value. In order to prevent the maximum value from continuously remaining at a value which occurs only rarely, the maximum value can be reduced slowly in small steps after each increase. It should be noted here that the above-mentioned maximum value can only be written into the register 28 when the adaptation for this volume flow has been completed. This can, for example, be realized in that the output signal of the preset unit 27 is not supplied directly to the register 28 but instead via an integrator which has the same time constant as the adaptation integrator 26.

If the above-described adaptive venting arrangement is used on a tank-venting apparatus 17 having an intensely buffering adaptation filter, increases and decreases of the volume flow through the tank-venting valve TEV can be handled in the same manner. A maximum value for the volume flow is then not written into the register 28; instead, a one-time write-in for a volume flow would take place for which the adaptation operation was carried out completely.

In the simple function diagram of FIG. 1, the adaptation addend adte is immediately reduced with a reduction of the volume flow vtev. As explained above in the summary of the invention, it is however more advantageous to delay the change of the adaptation factor by the time it takes for the vapor to flow between the tank-venting valve TEV and the injection device 13. A corresponding delay unit can be mounted anywhere between the preset unit 27 and the correcting summation unit 25.

Figure 4:
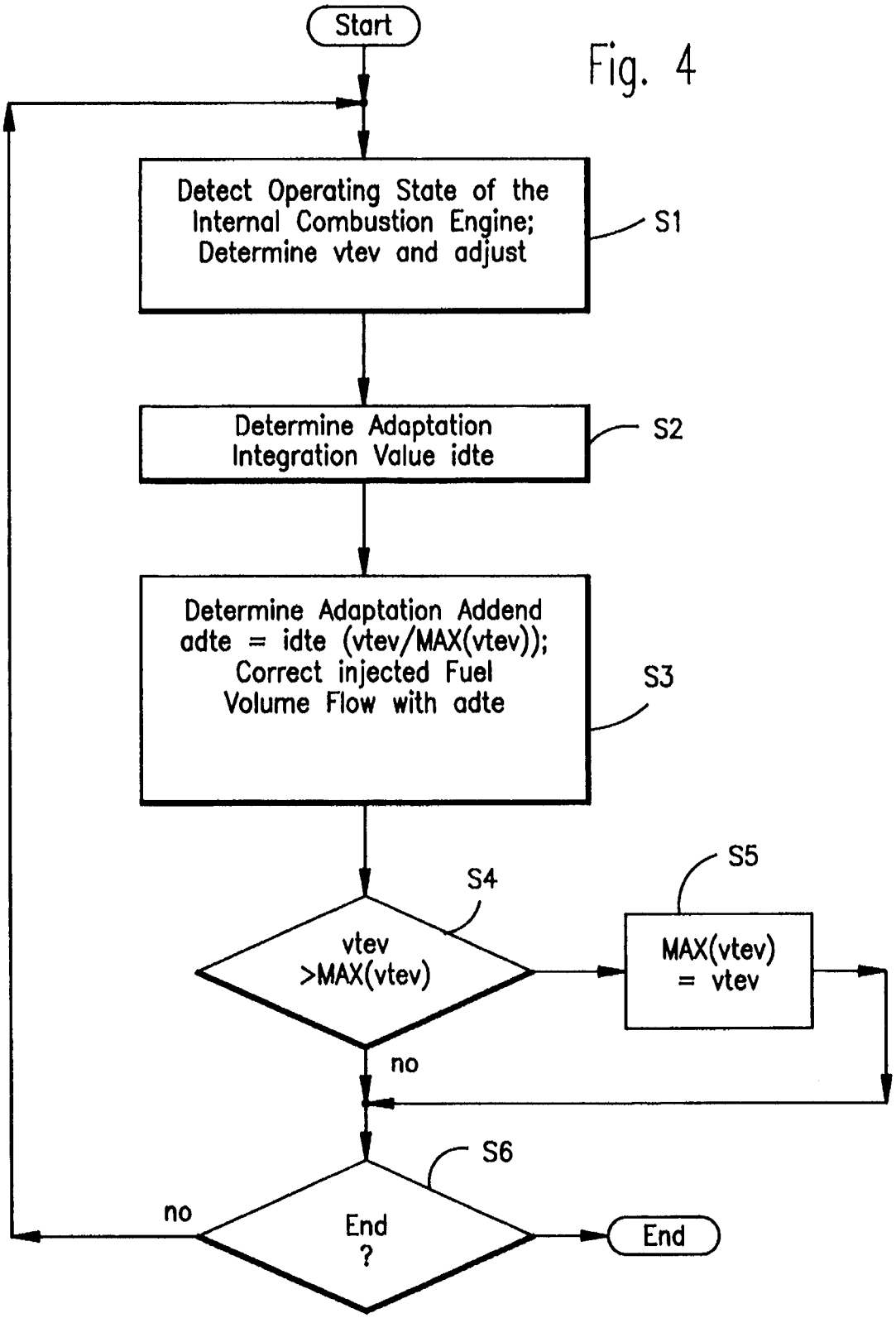

The mode of operation of the arrangement of FIG. 1 described above is now also explained with respect to the flowchart of FIG. 4.

In step S1, and after the start of the method carried out by the arrangement of the invention, the operating state of the engine 10 is detected and the volume flow vtev, which is applied for this mode of operation, is determined and is adjusted by a corresponding pulse-duty factor when driving the tank-venting valve TEV. The adaptation integration takes place with the aid of the adaptation integrator 26 in step S2. In step S3, the integrated value idte is modified with the volume flow ratio vtev/MAX (vtev). The fuel volume flow to be injected is corrected with the adaptation addend determined in this manner. Steps S4 and S5 are provided to investigate whether a new value for MAX (vtev) is to be set. If it is determined in step S4 that the actual volume flow is greater than the maximum value previously obtained, then the maximum value is set to the actual value in step S5. Final step S6 follows wherein the inquiry is made as to whether the method should be ended. If this is not the case, then the method runs anew starting with step S1; otherwise, the method is ended.

Figure 2:
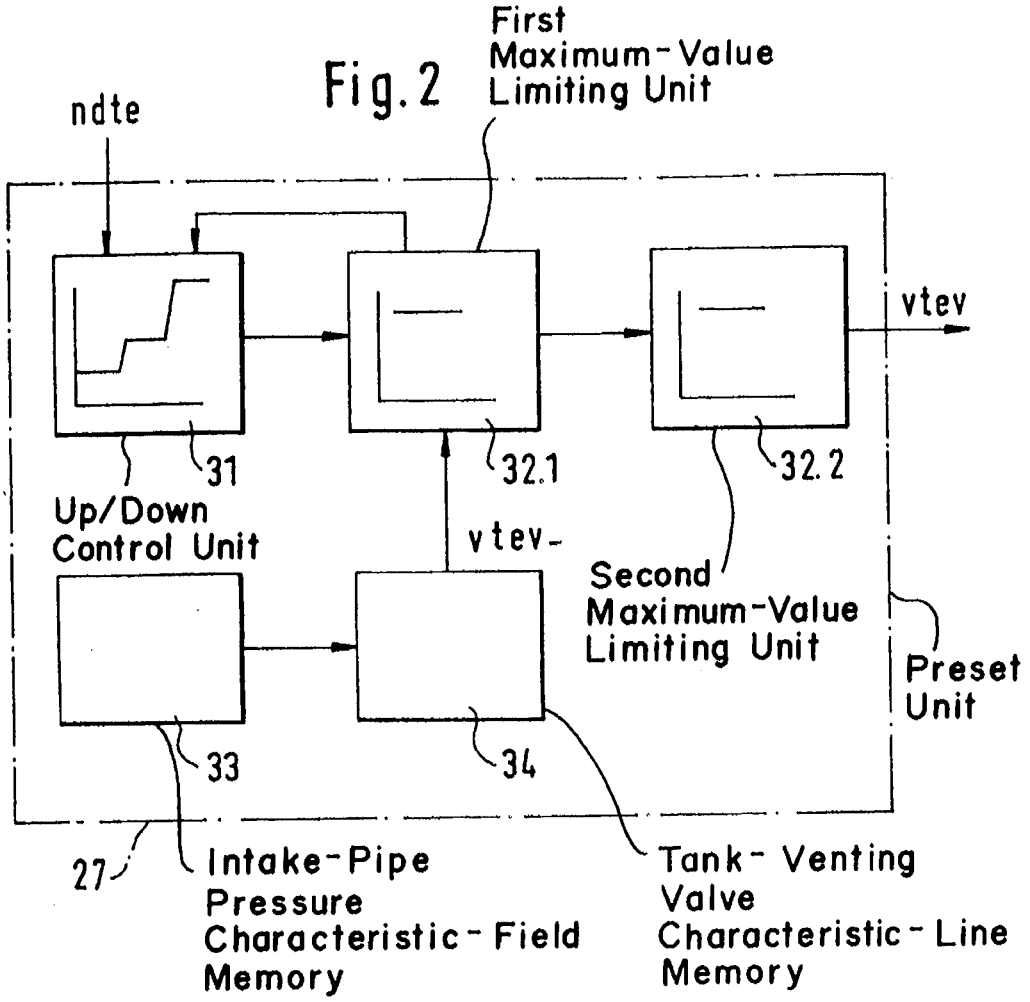
FIG. 2 is a function block diagram of a unit for adjusting the volume flow through the tank-venting valve in the arrangement of FIG. 1.

An embodiment is now described with respect to FIG. 2 for presetting the volume flow vtev through the tank-venting valve TEV. FIG. 2 shows the preset unit 27 in detail. The preset unit includes an up/down control unit 31, a first maximum-value limiting unit 32.1, a second maximum-value limiting unit 32.2, an intake-pipe pressure characteristic-field memory 33 and a tank-venting valve characteristic-line memory 34. The intake-pipe pressure is read out of the intake-pipe pressure characteristic-field memory 33 in dependence upon actual values of the rpm (n) and the inducted air mass LM. This characteristic field is not needed when an intake-pipe pressure sensor is provided. With the aid of the intake-pipe pressure and the ambient pressure, the maximum quantity of venting vapor which can flow through the tank-venting valve TEV is read out of the tank-venting valve characteristic-line memory 34, that is, when the tank-venting valve TEV is completely open. It is possible to here operate with pregiven ambient pressure if no ambient pressure sensor is provided.

The above-mentioned maximum value vtev_max for the volume flow is supplied to the first limiting unit 32.1. The limiting unit 32.1 limits the value outputted by the up/down control 31 to the particular actual maximum value. The second limiting unit 32.2 limits this value again but in dependence upon the actual air mass LM drawn in by suction. The volume flow is limited in this way twice under certain circumstances and is outputted as volume flow vtev. This arrangement permits to always work with the maximum possible volume flow for scavenging the tank-venting apparatus 17 for a pregiven mode of operation. This is in very intense contrast to the state of the art wherein the volume flow through the tank-venting valve would be set in proportion to the air flow through the intake pipe 11. There, the tank-venting apparatus can only be scavenged marginally in the lower load range of the engine.

At the start of a tank-venting phase, the up/down control unit 31 in this embodiment emits a value for the volume flow which corresponds to 5% of the maximum possible volume flow through the tank-venting valve (that is, not for the actual mode of operation). Assuming that the maximum value vtev_max, which applies for the actual operating conditions, is greater than this 5% of the absolute possible maximum value, then no limiting takes place in the first limiting unit 32.1. It is also intended that no limiting take place in the second limiting unit 32.2. After several seconds corresponding to the vapor running time between the injection unit 13 and the oxygen probe 15 (that is, when the mixture controller 21 could correct a possible mixture change), the up/down control unit 31 increases the pregiven volume flow to, for example, 10% of the absolute possible value. After respective like additional time durations, an increase to 20% takes place and then to 40%. The actual maximum value vtev _max corresponds however to only 30% of the absolute possible value. Then the first limiting unit 32.2 limits the value outputted by the up/down control unit 31. This limiting is fed back in order to prevent the up/down control unit 31 from being driven further. In this way, the volume flow vtev is limited to the actual possible maximum value. It is here noted that the second limiting unit 32.2 is effective only in exceptional cases, for example, during idle.

The up/down control unit 31 also receives the correcting value ndte outputted by the adaptation summation unit 23. When this correcting value exceeds a pregiven threshold in magnitude, this shows that the vapor drawn by suction from the tank-venting apparatus 17 influences the mixture generated by the injection more than wanted. The up/down control unit 31 then controls down the volume flow outputted thereby so far that the value ndte drops below the above-mentioned threshold.

It is noted that the up/down control unit 31 must not necessarily change the value outputted thereby in the above-mentioned large steps; instead, the value outputted by this unit can be changed in essentially a ramp form; that is, the value is changed in very small step increments. The second limiting unit 32.2 can be omitted in most applications. Furthermore, it is possible to read out the volume flow vtev from a characteristic field in which, by application, each of the volume flows through the tank-venting valve is written in. This possible volume flow is the maximum permissible for an operating point of the engine.

Figure 3:
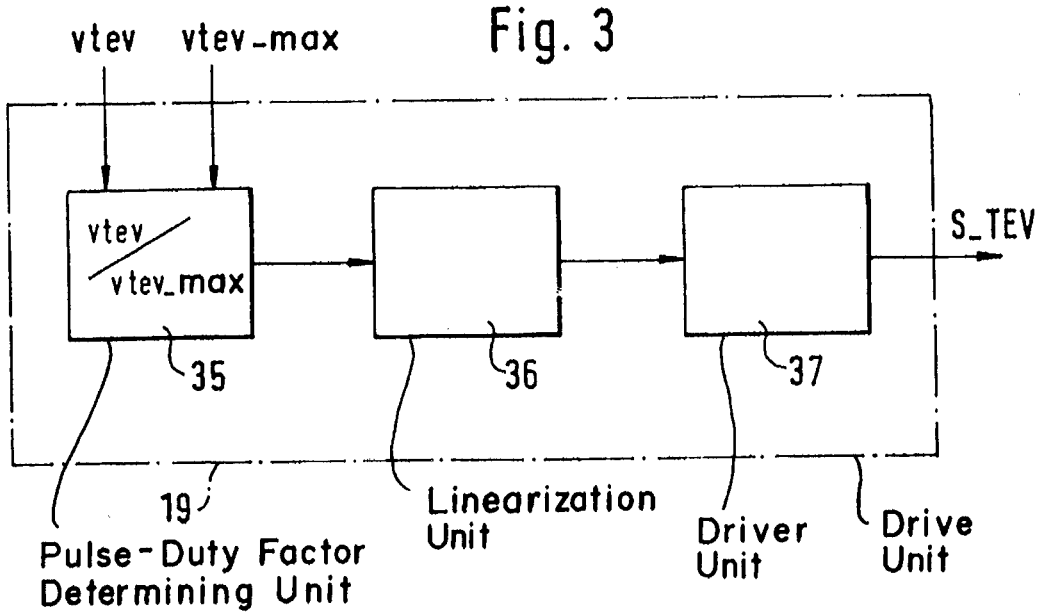
FIG. 3 is a function block diagram of a drive unit for the tank-venting valve; and, FIG. 4 is a flowchart for explaining an embodiment of the method of the invention.

FIG. 3 shows how the tank-venting valve TEV is driven in the embodiment and shows the drive unit 19 in detail. The drive unit 19 includes a pulse-duty factor determining unit 35, a linearization unit 36 and a driver unit 37. The pulse-duty factor determining unit 35 determines the quotient from the actual desired volume flow vtev and the actual maximum possible volume flow vtev_max. Since the volume flow through the tank-venting valve is not precisely proportional to the pulse-duty factor formed in this manner, the linearization unit 36 performs a linearization which comprises especially that for low given pulse-duty factors, these factors are somewhat increased. The tank-venting valve TEV is driven via the drive unit 37 at the pulse-duty factor corrected in this manner.

In the description provided above, it was always assumed that the tank-venting apparatus 17 was vented by means of underpressure in the intake pipe 11. In turbo engines (not shown) an additional line likewise leads to the intake pipe and is branched between the intake connection of the valve line and the tank-venting valve but forward of the charger. Check valves are then provided between the branched location and the intake pipe as well as in the valve line and also the additional line. These check valves in each case allow flow to the intake pipe. In turbo operation, an underpressure is present forward of the turbo charger and scavenging takes place via the additional line. The check valve in the valve line then prevents a backflow. In suction operation, the check valve in the additional line prevents the inducted air from avoiding the throttle flap.

It is understood that the foregoing description is that of the preferred embodiments of the invention and that various changes and modifications may be made thereto without departing from the spirit and scope of the invention as defined in the appended claims.

What is claimed is:

1. A method for controlling a tank-venting apparatus for an internal combustion engine having an intake pipe, the tank-venting apparatus being connected to the intake pipe via a tank-venting valve through which venting vapor is drawn from the tank-venting apparatus into the intake pipe, the method comprising the steps of:

presetting the volume flow for the venting vapor drawn from said tank-venting apparatus into said intake pipe in dependence upon the particular operating state of said engine;

adjusting said volume flow by correspondingly driving said tank-venting valve thereby reducing or increasing said volume flow;

forming an adaptation addend with the aid of a mixture controller;

changing said adaptation addend in the same direction as said volume flow is changed when said volume flow is reduced; and, the change of said adaptation addend being made proportionally to the change of said volume flow with respect to a fixed volume flow for which a one-time adaptation addend was determined.

2. The method of claim 1, wherein the proportionality factor is 1.

3. A method for controlling a tank-venting apparatus for an internal combustion engine including a fuel-injection device and having an intake pipe, the tank-venting apparatus being connected to the intake pipe via a tank-venting valve through which venting vapor is drawn from the tank-venting apparatus into the intake pipe, the method comprising the steps of:

presetting the volume flow for the venting vapor drawn from said tank-venting apparatus into said intake pipe in dependence upon the particular operating state of said engine;

adjusting said volume flow by correspondingly driving said tank-venting valve thereby reducing or increasing said volume flow;

forming an adaptation addend with the aid of a mixture controller;

changing said adaptation addend in the same direction as said volume flow is changed when said volume flow is reduced; and, delaying the change of said adaptation addend by the time needed for the vapor to travel between said tank-venting valve and said fuel-injection device with said time being referred to said change of said volume flow.

4. A method for controlling a tank-venting apparatus for an internal combustion engine having an intake pipe, the tank-venting apparatus being connected to the intake pipe via a tank-venting valve through which venting vapor is drawn from the tank-venting apparatus into the intake pipe, the method comprising the steps of:

presetting the volume flow for the venting vapor drawn from said tank-venting apparatus into said intake pipe in dependence upon the particular operating state of said engine;

adjusting said volume flow by correspondingly driving said tank-venting valve thereby reducing or increasing said volume flow;

forming an adaptation addend with the aid of a mixture controller;

changing said adaptation addend in the same direction as said volume flow is changed when said volume flow is reduced; and, said venting vapor volume flow being adjusted to the maximum possible value for each operating state of said engine.

5. An arrangement for controlling a tank-venting apparatus for an internal combustion engine having an intake pipe, the tank-venting apparatus being connected to the intake pipe via a tank-venting valve through which venting vapor is drawn from the tank-venting apparatus to the intake pipe, the arrangement comprising:

means for detecting the operating state of said engine;

means for outputting a precontrol value for the mixture setting of said engine in dependence upon said operating state thereof;

a mixture controller for outputting a correcting variable during a tank-venting phase;

an adaptation integrator for receiving said correcting variable to form an adaptation variable;

means for driving said tank-venting valve so that a pregiven volume flow through said tank-venting valve adjusts in dependence upon said operating state of said engine thereby reducing or increasing said volume flow;

means for modifying said adaptation variable at least for each reduction of said volume flow in the same direction as said volume flow is changed when said volume flow is reduced thereby forming a modified adaptation variable; and, summing means for adding said modified adaptation variable to said precontrol value.

* * * * *